US005463177A

United States Patent [19]

Youngs

[11] Patent Number: 5,463,177

[45] Date of Patent: Oct. 31, 1995

[54] SOLVENT EXTRACTION PROCESS

[75] Inventor: John K. Youngs, Wilmington, N.C.

[73] Assignee: General Electric Company, Schenectady, N.Y.

[21] Appl. No.: 294,584

[22] Filed: Aug. 23, 1994

[51] Int. Cl.[6] ..... C22B 60/02; B01D 11/00

[52] U.S. Cl. ..... 423/10; 423/8; 423/658.5; 588/20

[58] Field of Search ..... 423/249, 10, 8, 423/253, 658.5; 588/20

[56] References Cited

U.S. PATENT DOCUMENTS 4,190,461 2/1980 Hedger ..... 134/1
4,439,405 3/1984 Bailey et al. ..... 423/10
4,510,122 4/1985 FloreaNcig ..... 423/10
4,705,896 11/1987 Van Der Puy et al. ..... 564/265
4,787,979 11/1988 Kolarik et al. ..... 210/634

*Primary Examiner*—Ngoclan Mai
*Attorney, Agent, or Firm*—Nixon & Vanderhye

[57] ABSTRACT

The extraction process includes supplying solvent under gas pressure for introduction of the solvent adjacent the bottom of a vessel containing the sample. The vessel lies in a water bath and ultrasonic energy is applied to the bath and hence to the sample to facilitate interaction between the solvent and the sample. Because the solvent is immiscible in the sample and of lesser density, the solvent and solubilized material rise to the top of the vessel. An extraction tube under vacuum pressure continuously removes the solvent with the solubilized material.

17 Claims, 1 Drawing Sheet

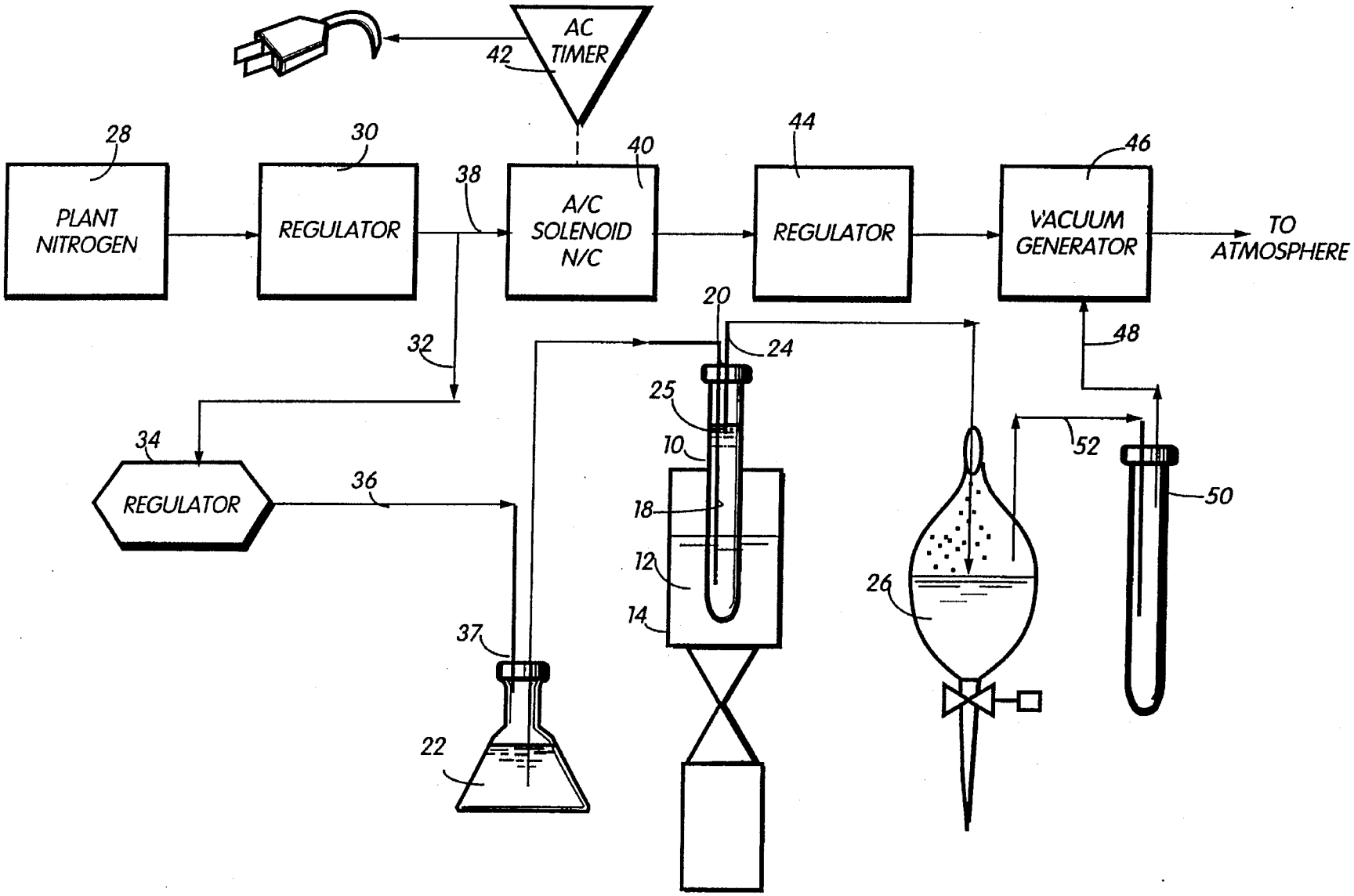
TO ATMOSPHERE
VACUUM GENERATOR
REGULATOR
A/C SOLENOID N/C
AC TIMER
REGULATOR
PLANT NITROGEN
REGULATOR
46
48
50
52
44
26
24
20
25
10
18
12
14
40
42
38
32
37
22
30
36
34
28

SOLVENT EXTRACTION PROCESS

TECHNICAL FIELD

The present invention relates to a novel and improved solvent extraction process and particularly relates to a process for the extraction of a material from a sample using ultrasonic energy to increase the contact between the solvent and sample whereby the material may be recovered and the sample purified.

BACKGROUND

There are many and well-known solvent extraction processes. Typically, a sample is combined with a solvent in a container and the is contents of the container mixed by mechanical agitation, such as stirring or shaking. After the solvent and sample are thoroughly mixed, the mixture is allowed to stand over time such that the material to be removed from the sample is solubilized in the solvent and the solvent with the solubilized material separates from the sample. The separation is effected conventionally by gravity, that the density of the solvent with solubilized sample is different from the density of the sample. Typically, the density of the solvent with solubilized material is less than the density of the sample such that the solvent with the solubilized material rises to the surface of the container. The solvent with the solubilized material is drawn off from the vessel and additional clean solvent is combined with the remaining sample and the process is repeated until the desired concentrations are reached. It will be appreciated that processes such as described are used to either purify the sample or to recover the material from the sample, or both.

In the foregoing-described process, it will be further appreciated that the steps necessary to perform the process involve use of a substantial number of various component parts, as well as significant handling of those parts. This causes a variety of problems. For example, the repeated processing of the sample places it in contact with a large number of parts such as mixers, stirrers and various containers. There is a significant potential for contaminating the sample and/or the solvent with foreign substances from those parts. Further, there is the potential danger of splashing the sample or solvent, or both, which could be hazardous to the individuals performing the extraction process, particularly where the solvents are toxic. Still further, multiple measuring and liquid transfers occur in such systems. These are not only labor-intensive but prone to error and increase the likelihood of loss.

DISCLOSURE OF THE INVENTION

In accordance with the present invention, there is provided a novel method of solvent extraction employing ultrasonic energy for enhancing the contact between the solvent and sample particularly by shearing the sample and the solvent into small particles or bubbles, greatly increasing the surface areas and hence the contact area of the solvent with the sample and facilitating uniform distribution of the solvent throughout the vessel. Also, by rendering the solvent into small bubbles, the mobility of the solvent during the separation phase of the process is enhanced. Moreover, the present extraction process can be carried out with relatively simple mechanical elements, with a minimum number of containers and without subjecting the sample to foreign bodies, such as stirrers or the like, which have the potential for contamination. Particularly, the present invention provides a vessel for containing the sample. A solvent is introduced into the vessel through a solvent supply tube, the solvent being introduced, preferably, adjacent the bottom of the vessel. A solvent-material or contaminate extraction tube is located on the top of the vessel. The extraction tube terminates in the vessel in a region or at an elevation predominantly containing the solvent with the solubilized material from the sample after separation from the sample, thereby enabling the solvent with the solubilized material to be withdrawn from the vessel. The latter is withdrawn from the vessel into a separate container which may be considered a waste container, if the solvent extraction process is used to purify the sample, or a container for the solubilized material being recovered. The vessel can be located within a water bath and ultrasonic energy can be applied to the water bath whereby the contents of the vessel are vibrated to effectively intermix the solvent and sample. Alternatively, ultrasonic energy can be applied directly to the sample. e.g., by an ultrasonic probe. The vibration may occur, for example, at a frequency of about 21 kHz.

To ensure a continuous flow of clean solvent into the vessel and continuous removal of the contaminated solvent from the vessel, the extraction system can be maintained substantially closed and pressurized. For example, the clean solvent container can be maintained under slight pressure from a gas source, for example, nitrogen, whereby the solvent is forced under gas pressure into the vessel on a slow, continuous basis. Additionally, the container receiving the contaminated solvent can be maintained under a slight negative pressure such that the contaminated solvent may be withdrawn through the extraction tube from the vessel. As a consequence, it will be appreciated that pumps, mixers, stirrers or other containers or other apparatus, which could otherwise contaminate the sample, are not utilized and only a single container for the sample is used for the entire extraction process. This minimizes or eliminates the potential for introducing foreign contaminants into the system.

While the foregoing-described extraction process of the present invention has general application for extracting many different materials from samples, it has specific applicability to the extraction of uranium from a sample containing nitric acid, uranyl nitrate and traces of metal impurities such that an analysis of the remaining sample can be performed as well as to the recovery of the uranium itself. Thus, in one application, the uranium is removed so that the uranium does not interfere with subsequent spectroscopic examination of the sample. Of course, the process can be used simultaneously to extract uranium from a sample whereby uranium may be recovered.

In a preferred embodiment according to the present invention, there is provided a process for extracting a material from a sample comprising the steps of disposing the sample containing the material in a vessel, introducing an extracting solvent adjacent the bottom of the vessel containing the sample, the solvent being immiscible with the sample and having a density less than the density of the sample, applying ultrasonic energy to the contents of the vessel to facilitate solubilizing at least a portion of the material into the solvent so that the solvent containing at least a portion of the material rises through the sample toward the top of the vessel and removing the extracting solvent containing the material portion from the vessel.

In a further preferred embodiment according to the present invention, there is provided a process for extracting uranium from a sample containing the uranium comprising the steps of disposing the sample containing the uranium in a vessel, introducing a solvent in which the uranium is soluble adjacent the bottom of the vessel containing the sample with the uranium therein, the solvent being immiscible with respect to the sample and having a density less than the density of the sample, applying ultrasonic energy to the sample containing uranium in the vessel to facilitate solubilization of at least a portion of the uranium in the solvent so that the solvent containing solubilized uranium rises through the sample toward the top of the vessel and removing the solvent containing the uranium from the vessel.

Accordingly, it is a primary object of the present invention to provide a novel and improved extraction process employing ultrasonic energy for facilitating the contact between a solvent and the sample whereby the extraction process can be accomplished continuously, in a much shorter period of time as compared with previous methods, without danger of contamination from foreign substances, with less handling and equipment, and more efficient use of the solvent.

BRIEF DESCRIPTION OF THE DRAWING

FIG. 1, the sole drawing figure, is a schematic illustration of a solvent extraction process according to the present invention.

BEST MODE FOR CARRYING OUT THE INVENTION

Referring now to the drawing, there is illustrated in a preferred embodiment of the present invention, a vessel 10 for containing a sample, the vessel 10 being disposed in a water bath 12 confined within a larger container 14. A sonicator for producing ultrasonic energy is coupled to the container 14 for transmitting ultrasonic energy through the water bath to the contents of vessel 10. The sonicator is preferably operative at a frequency of 21 kHz. The vessel 10 is supported in the water in any known manner.

A solvent supply tube 18 passes through a sealed cap 20 on vessel 10, and terminates adjacent the bottom of vessel 10. The opposite end of the supply tube 18 is immersed in a solvent supply container 22 whereby, as described hereafter, solvent is pumped to vessel 10 from container 22 for egress into vessel 10 adjacent its bottom surface. A solvent-with-solubilized-material (hereafter solvent-material) extraction tube 24 is also passed through the cap 20. The lower end of the extraction tube 24 within vessel 10 terminates at an elevation or in a region 25 corresponding to an elevation at which the separated solvent-material is collected in the vessel 10. The opposite end of the extraction tube 24 is connected to a further container 26 for receiving the solvent-material.

From the foregoing description, it will be appreciated that the sample, together with the solvent in the vessel 10, are ultrasonically vibrated by the sonicator. The ultrasonic energy increases the contact between the solvent and the sample by shearing the sample and the solvent into small particles, increasing the total surface area of the sample exposed to the solvent. Because the solvent is less dense than the sample, as well as immiscible in the sample, it is necessary to introduce the solvent adjacent the bottom of the vessel 10 so that the solvent may flow uniformly upwardly through the sample as the solvent dissolves portions of the material of the sample. Thus, the solvent carries with it toward the upper end of vessel 10 the solubilized material and simultaneously effects a separation from the sample. As illustrated, the solvent-material rises to the collection region 25 within vessel 10 such that the solvent-material may be drawn from the vessel 10 through the lower end of the extraction tube 24 for passage to container 26.

In order to continuously supply solvent to vessel 10 and simultaneously continuously remove the solvent-material from vessel 10, and without the need for additional containers and other equipment, as well as any additional handling, a pressurized system is employed to pump the solvent into vessel 10 and remove the solvent-material from vessel 10. With reference to the drawing figure, a source 28 of gas, preferably nitrogen, is supplied to a regulator 30. Gas from regulator 30 flows through a branch line 32 to another regulator 34 for passage through line 36 into solvent container 22 through a closure cap 37 to pressurize the solvent container. Another branch line 38 from regulator 30 flows through a solenoid actuated gas valve 40 that permits gas flow only when a timer 42 has been activated. When activated, the gas flows through valve 40 to a regulator 44 to drive a venturi vacuum generator 46. Generator 46 provides a negative pressure in a branch line 48 connected to a liquid trap 50, in turn connected via line 52 to the container 26. Consequently, by pressurizing the solvent in container 22, solvent is supplied to the vessel 10. Additionally, the negative pressure in the container 26 enables the solvent-material to be withdrawn from vessel 10 into container 26. As a consequence, the supply of solvent and the removal of solvent-material relative to vessel 10 is accomplished by a differential pressure system and without the aid of any further mechanical parts or additional equipment and without further handling.

In a preferred embodiment of the present invention, uranium may be separated from a sample containing trace amounts of unknown metals for purposes of purifying the sample such that the sample can be analyzed, for example, by a spectrometer. Particularly, and in this preferred embodiment, 1 ml of reagent grade (16N) nitric acid is added to 5 ml of the sample containing uranyl nitrate ($UO_2(NO_3)_2$) and traces of metals, both being disposed in vessel 10. Water is supplied in container 14 to envelop approximately half of vessel 10 containing the sample and nitric acid. Solvent container 22 is provided with a solvent, for example, 25–30 volume % tri-n-butyl phosphate in n-dodecane. The caps 37 and 20 are applied to the vessel 10 and solvent container 22, respectively, to seal the system. With gas being provided from source 28, timer 42 is set, e.g., six minutes. Thus, gas from source 28 pressurizes the solvent container 22 via branch lines 32 and 36 to supply solvent into vessel 10 with the solvent being input vessel 10 adjacent its bottom. Ultrasonic energy is simultaneously applied to the solvent and the sample such that at least a portion of the material of the sample may be solubilized in the solvent as the solvent with the solubilized material rises to the top of vessel 10. Because the solvent and sample are immiscible with respect to one another and the solvent with the solubilized material, e.g., uranium, is of less density than the sample, the solvent-material will pass upwardly in vessel 10 to accumulate in the collection region 25 adjacent the top portion of vessel 10. As indicated previously, the lower end of the extraction tube 24 lies in communication with the separation zone. Hence, the vacuum pressure removes the solvent with the solubilized material, e.g., uranium, to container 26. When the timer has timed-out, the system may be opened and the sample may be removed from the vessel 10.

It will be appreciated that the objectives of the present invention are fully met by the foregoing process. Particularly, the sample is confined to a single vessel 10 during separation and extraction and additional equipment, such as stirrers, mixers, containers and the like are not required during the extraction process whereby the danger of contaminating the sample and/or solvent is minimized or eliminated. Additionally, the pressure system enables pumping of the solvent into the vessel 10 and removal of the solvent with the solubilized material while the system is completely closed, further preventing the introduction of foreign contaminants, as well as avoiding the hazards of splashing sample or solvent.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for extracting uranium from a sample containing the uranium comprising the steps of:

disposing the sample containing the uranium in a vessel;

introducing a solvent in which the uranium is soluble adjacent the bottom of the vessel containing the sample with the uranium therein, the solvent being immiscible with respect to the sample and having a density less than the density of the sample;

applying ultrasonic energy to the sample containing uranium in the vessel to facilitate solubilization of at least a portion of the uranium in the solvent so that the solvent containing solubilized uranium rises through the sample toward the top of the vessel; and removing the solvent containing the uranium from the vessel.

2. A process according to claim 1 wherein the solvent is tri-n-butyl phosphate in n-dodecane.

3. A process according to claim 2 wherein the solvent is 25–30% by volume tri-n-butyl phosphate in n-dodecane.

4. A process according to claim 1 including continuously introducing the solvent adjacent the bottom of the vessel and continuously removing the solvent containing the uranium from the vessel.

5. A process according to claim 1 wherein the step of introducing includes passing the solvent through the solvent containing solubilized uranium adjacent the top of the vessel to adjacent the bottom of the vessel.

6. A process according to claim 1 including immersing at least part of said vessel in a water bath, and applying the ultrasonic energy to said water bath for transmission to said vessel and the sample and solvent therein.

7. A process according to claim 6 including applying ultrasonic energy to said water bath at a frequency of about 21 kHz.

8. A process according to claim 1 including flowing the solvent into the vessel by applying a differential pressure to the solvent.

9. A process according to claim 1 including removing the solvent containing the uranium from the vessel by applying a differential pressure to the solvent and solubilized material portion.

10. A process according to claim 1 including flowing the solvent into the vessel and removing the solvent containing the uranium from the vessel by applying differential pressures to the solvent and solvent containing the uranium, respectively.

11. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent containing said material portion from the vessel; and continuously introducing the solvent adjacent the bottom of the vessel and continuously removing the solvent and solubilized material portion from the vessel.

12. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent containing said material portion from the vessel; and wherein the step of introducing includes passing the solvent through the solvent containing said portion of the material adjacent the top of the vessel to adjacent the bottom of the vessel.

13. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent containing said material portion from the vessel; and wherein the material is uranium and the solvent is a volume % of tri-n-butyl phosphate in n-dodecane.

14. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

immersing at least part of said vessel in a water bath;

applying ultrasonic energy to said water bath at a frequency of about 21 kHz for transmission to said vessel and the sample and solvent therein to facilitate solubilizing at least a portion of the material into the solvent so that the solvent containing said at least a portion of the material rises through the sample toward the top of the vessel; and removing the extracting solvent containing said material portion from the vessel.

15. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent containing said material portion from the vessel; and flowing the solvent into the vessel by applying a differential pressure to the solvent.

16. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent and solubilized material portion from the vessel by applying a differential pressure to the solvent and solubilized material portion.

17. A process for extracting a material from a sample comprising the steps of:

disposing the sample containing the material in a vessel;

introducing an extracting solvent adjacent the bottom of the vessel containing the sample, the solvent being immiscible with the sample and having a density less than the density of the sample;

applying ultrasonic energy to the contents of the vessel to facilitate solubilizing at least a portion of the material into the solvent so that the solvent containing said at least a portion of the material rises through the sample toward the top of the vessel;

removing the extracting solvent containing said material portion from the vessel; and flowing the solvent into the vessel and removing the solvent and solubilized material portion from the vessel by applying differential pressures to the solvent and solvent with solubilized portion therein.

* * * * *